US010785575B2

(12) United States Patent
Billson et al.

(10) Patent No.: US 10,785,575 B2
(45) Date of Patent: Sep. 22, 2020

(54) ELECTROSTATIC TRANSDUCER

(71) Applicant: Warwick Acoustics Limited, Nuneaton (GB)

(72) Inventors: Duncan Billson, Warwickshire (GB); Brian Atkins, Osbaston (GB); Kevin Walsh, Brynhyfryd (GB)

(73) Assignee: WARWICK ACOUSTICS LIMITED, Nuneaton (GB)

( * ) Notice: Subject to any disclaimer, the term of this patent is extended or adjusted under 35 U.S.C. 154(b) by 359 days.

(21) Appl. No.: 15/118,172

(22) PCT Filed: Feb. 11, 2015

(86) PCT No.: PCT/GB2015/050375
§ 371 (c)(1),
(2) Date: Aug. 11, 2016

(87) PCT Pub. No.: WO2015/121641
PCT Pub. Date: Aug. 20, 2015

(65) Prior Publication Data

US 2017/0171669 A1 Jun. 15, 2017

(30) Foreign Application Priority Data

Feb. 11, 2014 (GB) ..... 1402362.6

(51) Int. Cl.
*H04R 19/02* (2006.01)
*H04R 19/00* (2006.01)

(52) U.S. Cl.
CPC ..... *H04R 19/02* (2013.01); *H04R 19/005* (2013.01); *H04R 2201/403* (2013.01)

(58) Field of Classification Search
CPC . H04R 19/02; H04R 19/005; H04R 2201/403
(Continued)

(56) References Cited

U.S. PATENT DOCUMENTS 2,975,243 A 3/1961 Katella
3,895,193 A 7/1975 Bobb
(Continued)

FOREIGN PATENT DOCUMENTS

CA 2195442 2/1996
CN 1333993 A 1/2002
(Continued)

OTHER PUBLICATIONS

International Searching Authority, International Search Report and Written Opinion dated Apr. 30, 2016, issued in connection with International Application No. PCT/GB2015/050372, filed on Feb. 11, 2015, 9 pages.
(Continued)

*Primary Examiner* — Sean H Nguyen
(74) *Attorney, Agent, or Firm* — McDonnell Boehnen Hulbert & Berghoff LLP

(57) ABSTRACT

An electrostatic transducer (100) comprises an electrically conductive backplane member (102) having an array of through apertures (112); a spacer member (104) disposed over the backplane member (102), the spacer member (104) having an array of holes (114) therethrough, the holes (114) each having a maximum lateral dimension less than twice a minimum lateral dimension; and a flexible electrically conductive membrane (106) disposed over the spacer member (104). The transducer (100) is arranged in use to apply an electrical potential which gives rise to an attractive electrostatic force between the backplane member (102) and the membrane (106) thereby moving portions of the membrane (106) spanning said holes in the spacer member (104) towards said backplane member (102).

28 Claims, 3 Drawing Sheets

(58) Field of Classification Search
USPC ..... 381/191
See application file for complete search history.

(56) References Cited

U.S. PATENT DOCUMENTS

| | | | |
|---|---|---|---|
| 3,908,098 | A | 9/1975 | Kawakami et al. |
| 3,935,397 | A | 1/1976 | West |
| 3,942,029 | A | 3/1976 | Kawakami et al. |
| 3,992,585 | A | 11/1976 | Turner et al. |
| 4,533,794 | A | 8/1985 | Beveridge |
| 5,161,128 | A | 11/1992 | Kenney |
| 5,471,540 | A | 11/1995 | Maeda |
| 6,044,160 | A | 3/2000 | Norris |
| 6,201,874 | B1 | 3/2001 | Croft, III et al. |
| 6,628,791 | B1 | 9/2003 | Bank et al. |
| 7,076,070 | B2 | 7/2006 | Pierce et al. |
| 7,095,864 | B1 | 8/2006 | Billson et al. |
| 2002/0135272 | A1 | 9/2002 | Toda |
| 2002/0141606 | A1 | 10/2002 | Schweder et al. |
| 2003/0123683 | A1 | 7/2003 | Raicevich |
| 2006/0208609 | A1 | 9/2006 | Heim |
| 2007/0121970 | A1 | 5/2007 | Miyazaki |
| 2007/0124620 | A1 | 5/2007 | Miyazaki |
| 2007/0189559 | A1 | 8/2007 | Haan et al. |
| 2009/0016551 | A1 | 1/2009 | Chiang et al. |
| 2009/0041266 | A1 | 2/2009 | Guo et al. |
| 2009/0304212 | A1 | 12/2009 | Han et al. |
| 2010/0135519 | A1 | 6/2010 | Werners et al. |
| 2012/0014543 | A1 | 1/2012 | Chiang et al. |
| 2012/0237069 | A1 | 9/2012 | Harman |
| 2013/0044899 | A1* | 2/2013 | Barber ..... H04R 19/016 381/113 |
| 2013/0044905 | A1 | 2/2013 | Lee et al. |
| 2017/0171668 | A1 | 6/2017 | Billson et al. |

FOREIGN PATENT DOCUMENTS

| | | | |
|---|---|---|---|
| CN | 101256900 | A | 9/2008 |
| CN | 101346015 | A | 1/2009 |
| CN | 101651915 | A | 2/2010 |
| CN | 201657310 | | 11/2010 |
| CN | 102355619 | A | 2/2012 |
| EP | 2043386 | | 4/2009 |
| EP | 2312868 | | 4/2011 |
| GB | 228176 | | 7/1926 |
| GB | 2413027 | | 10/2005 |
| GB | 2490931 | | 11/2012 |
| JP | 60046196 | | 3/1985 |
| JP | 60-157399 | A | 8/1985 |
| JP | 2007-067483 | A | 3/2007 |
| JP | 2008-022501 | A | 1/2008 |
| JP | 2008-085507 | A | 4/2008 |
| JP | 2008-172696 | A | 7/2008 |
| JP | 2009-038637 | A | 2/2009 |
| JP | 2009100438 | | 5/2009 |
| JP | 2009153056 | | 7/2009 |
| JP | 2009284397 | | 12/2009 |
| JP | 2009296125 | | 12/2009 |
| JP | 2010-034779 | A | 2/2010 |
| JP | 2012-028900 | A | 2/2012 |
| JP | 2013-058889 | A | 3/2013 |
| WO | 1993/01691 | | 1/1993 |
| WO | 1996/03806 | | 2/1996 |
| WO | 1998/35529 | | 8/1998 |
| WO | 2000/35246 | | 6/2000 |
| WO | 2001073861 | A1 | 10/2001 |
| WO | 2002/19764 | | 3/2002 |
| WO | 2007/077438 | | 7/2007 |

OTHER PUBLICATIONS

International Searching Authority, International Search Report and Written Opinion dated Apr. 30, 2016, issued in connection with International Application No. PCT/GB2015/050375, filed on Feb. 11, 2015, 11 pages.
UK Intellectual Property Office, Search Report dated Apr. 27, 2016, issued in connection with Application No. GB1402362.6, 3 pages.
UK Intellectual Property Office, Search Report dated Apr. 30, 2016, issued in connection with Application No. GB1402363.4, 4 pages.
Chinese Office Action dated Aug. 29, 2018, for Chinese Patent Application No. 201580019334.6, pp. 1-7.
Japanese Office Action dated Jan. 29, 2019 for Japanese Patent Application No. 2016-551231, pp. 1-5.
Decision of Rejection, for Japanese Application No. JP2016-551229, dated Aug. 1, 2013, pp. 1-6.

* cited by examiner

ELECTROSTATIC TRANSDUCER

CROSS-REFERENCE

This application is a section 371 of International application no. PCT/GB2015/050375, filed Feb. 11, 2015 which claims priority from GB 1402362.6, filed Feb. 11, 2014, which is incorporated by reference in its entirety.

FIELD

This invention relates to an electrostatic transducer and is particularly but not exclusively concerned with a loudspeaker suitable for reproducing audio signals.

BACKGROUND

A traditional electrostatic loudspeaker comprises a conductive membrane disposed between two perforated conductive backplates to form a capacitor. A DC bias is applied to the membrane and an AC signal voltage is applied to the two backplates. Voltages of hundreds or even thousands of volts may be required. The signals cause an electrostatic force to be exerted on the charged membrane, which moves to drive the air on either side of it.

In U.S. Pat. No. 7,095,864, there is disclosed an electrostatic loudspeaker comprising a multilayer panel. An electrically insulating layer is sandwiched between two electrically conducting outer layers. The insulating layer has circular pits on one of its sides. It is said that when a DC bias is applied across the two conducting layers, portions of one of the layers are drawn onto the insulating layer to form small drum skins across the pits. When an AC signal is applied, the drum skins resonate, and parts of that conducting layer vibrate to produce the required sound.

In WO 2007/077438 there is disclosed an further type of electrostatic loudspeaker comprising a multilayer panel. An electrically insulating layer is sandwiched between two electrically conducting outer layers. In this arrangement, one of the outer conducting layers is perforated and, for example, may be a woven wire mesh providing apertures with a size of typically 0.11 mm.

In US 2009/0304212 there is disclosed an electrostatic loudspeaker comprising a conductive backplate provided with an array of vent holes and an array of spacers. Over this is positioned a membrane comprising a dielectric and a conductive film. The space between the backplate and the membrane is about 0.1 mm and it is said that a low voltage supplied to the conductive backplate and the conductive film will push the membrane to produce audio.

One problem with electrostatic loudspeakers of this type is obtaining sufficient displacement of the membrane. WO 2012/156753 discloses an electrostatic transducer comprising an electrically conductive first layer having through apertures, a flexible insulating second layer over the first layer, and a flexible electrically conductive third layer disposed over the second layer. Spaces are provided between the first and second layers or between the second and third layers. Spaces between the first and second layers allows greater freedom of movement of the second and third layers, allowing greater displacement of the second and third layers. Spaces between the second and third layers were also found to improve acoustic performance.

However, there remains a need for further improvement in the acoustic performance of electrostatic transducers of this type.

SUMMARY

The present invention relates to electrostatic transducer (100) comprising an electrically conductive backplane member (102) having an array of through apertures (112); a spacer member (104) disposed over the backplane member (102), the spacer member (104) having an array of holes (114) therethrough, the holes (114) each having a maximum lateral dimension less than twice a minimum lateral dimension; and a flexible electrically conductive membrane (106) disposed over the spacer member (104). The transducer (100) is arranged in use to apply an electrical potential which gives rise to an attractive electrostatic force between the backplane member (102) and the membrane (106) thereby moving portions of the membrane (106) spanning said holes in the spacer member (104) towards said backplane member (102).

DESCRIPTION OF THE DRAWINGS

Certain preferred embodiments of the present invention will now be described, by way of example only, with reference to the accompanying drawings in which.

DETAILED DESCRIPTION OF THE INVENTION

Figure 1:
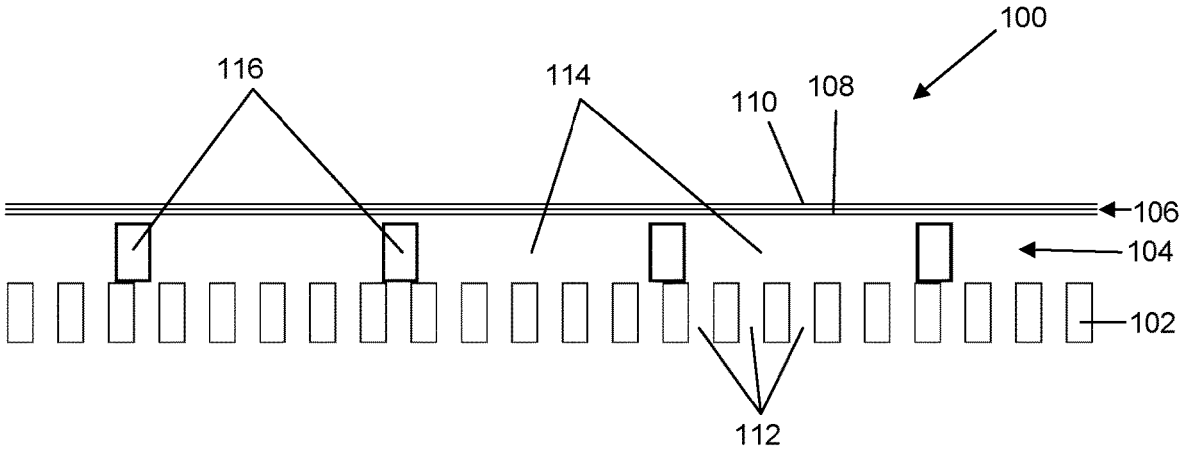
FIG. 1 is a diagrammatic section through a transducer in accordance with one embodiment of the invention, showing the position of a flexible electrically conducting membrane disposed over a spacer member having holes therethrough, when zero electrical potential is applied to the transducer.

When viewed from a first aspect the invention provides an electrostatic transducer comprising:

- an electrically conductive backplane member having an array of through apertures;
- a spacer member disposed over the backplane member, the spacer member having an array of holes therethrough, the holes each having a maximum lateral dimension less than twice a minimum lateral dimension; and
- a flexible electrically conductive membrane disposed over the spacer member;
- wherein the transducer is arranged in use to apply an electrical potential which gives rise to an attractive electrostatic force between the backplane member and the membrane thereby moving portions of the membrane spanning said holes in the spacer member towards said backplane member.

Thus it will be seen by those skilled in the art that the holes provided in the spacer member cooperate with the membrane to provide an array of regions where a 'drumskin' effect is produced. Optimal performance has been found to be achieved when the holes have similar dimension all the way round. The ratio between the maximum and minimum lateral dimensions may be less than 1.5 e.g. less than 1.2.

Furthermore the tension generated in the membrane when portions are moved towards the backplane member provides a return force when there is a decrease in the electrostatic potential (and so reduction in the electrostatic force). The present invention therefore improves on previous, similar transducers by effectively introducing a "return spring" into the transducer, significantly improving its acoustic performance. For example such arrangements may increase the usable frequency range and improve the overall quality of the sound generated by a transducer. This is illustrated by a 6 dB increase in the sound pressure level between 200 Hz and 5 kHz having been observed in some embodiments.

The membrane may be arranged so that it is not initially in contact with the spacer member—i.e. when zero electrical potential is applied. In such cases, the membrane may be brought into contact with the spacer by the application of the electrical potential, which attracts the membrane to the backplane member. The portions of the membrane spanning the holes in the spacer member are thus able move in response to the electrical potential in the manner described above. Equally the membrane may be held in contact with the spacer member e.g. by a mechanical pre-tension, by bonding or by an electrical potential. For example, a d.c. bias potential may be applied to maintain the membrane in contact with the spacer, while an a.c. drive signal is applied in addition to the d.c. signal to drive the motion of the portions spanning the holes.

The invention as outlined above could be applied to so-called push-pull transducers in which two backplane members are provided on either side of the membrane to move it in both directions. However in preferred embodiments the transducer is arranged in use to apply an electrical potential which gives rise only to an attractive electrostatic force between the backplane member and the membrane. In such an arrangement only a single backplane member is necessary. The return force mentioned hereinabove allows good acoustic performance to be achieved nonetheless.

Such an arrangement is novel and inventive in its own right, therefore when viewed from a second aspect the invention provides an electrostatic transducer comprising:

- an electrically conductive backplane member having an array of through apertures;
- a spacer member disposed over the backplane member, the spacer member having an array of holes therethrough; and
- a flexible electrically conductive membrane disposed over the spacer member;
- wherein the transducer is arranged in use to apply an electrical potential which gives rise only to an attractive electrostatic force between the backplane member and the membrane thereby moving portions of the membrane spanning said holes in the spacer member towards said backplane member.

Any suitable shape for the holes may be used, but in preferred embodiments the holes each have a maximum lateral dimension less than twice a minimum lateral dimension for the reasons given above.

Except where explicitly provided otherwise, the features discussed hereinbelow may be applied either to the first aspect of the invention or to the second aspect of the invention.

The size, shape, spacing and pattern of the holes in the spacer member may affect the magnitude of the tension introduced to the membrane, as well as affecting the regions of the membrane where tension is created. Accordingly, the size, shape, spacing and pattern of the hole may be optimised to generate a desired amount of tension, or to maximise the tension generated in the membrane. In some embodiments the holes have a shape that is selected from the group consisting of: circular, hexagonal, square and oval. However, other shapes are possible.

The holes in the spacer member may be any suitable size, however in some embodiments the holes have a maximum lateral dimension between 1 mm and 50 mm, e.g. between 10 mm and 40 mm, e.g. between 20 mm and 30 mm, e.g. about 25 mm. In some embodiments the holes in the spacer member are larger than the apertures in the backplane member. The holes may have a maximum lateral dimension between 2 and 50 times greater than the maximum lateral dimension of the apertures in the backplane member, e.g. between 10 and 40 times greater, e.g. between 20 and 30 times greater, e.g. around 25 times greater.

The spacing between the holes in the spacer member may have any suitable dimension. However, as sound may be generated by the membrane only or mainly where it is free to vibrate over the holes of the spacer member, it is preferable that the spacing between the holes is much less than the size of the holes. However, the spacing should not be so small as to adversely affect the support provided to the membrane by the spacer member, or so small that damage is caused to the membrane due to the pressure of the reaction force of the spacer member. Accordingly, in preferred embodiments the spacing between the holes in the spacer member is between 1 and 5 mm, e.g. between 2 and 4 mm, e.g. about 3 mm.

In some embodiments, every hole in the spacer member has the same size and shape. However, this is not essential: it is possible for holes in the spacer member to have different sizes and different shapes. For example, the spacer member could have an array of holes comprising some holes that are 20 mm and circular and some holes that are 30 mm and circular. As another example, the spacer member could have some holes that are hexagonal, and some holes that are square. The size, spacing, shape and/or pattern of the holes may vary across the surface of the spacer member. For example, larger holes may be provided towards the centre of the spacer member and smaller holes towards the edge. As another example, the spacer member could be provided with a hexagonal array of hexagonal holes in one portion of the spacer member and a square array of square holes in another portion of the spacer member.

The holes may be arranged in any suitable pattern or arrangement. However, as discussed above, it is preferable in some circumstances that the spacing between the holes is not too large so as to maximise the area of the membrane that can vibrate over the holes of the spacer member. Therefore, in some embodiments, the holes are arranged in a hexagonal close packed array. In some other embodiments the holes are arranged in a square lattice arrangement. The holes may be provided with a suitable shape to minimise the spacing between the holes, i.e. substantially tessellating shapes. For example, if the array is a hexagonal close packed array, the holes may have a hexagonal shape (i.e. a honeycomb arrangement). If the holes are arranged in a square lattice arrangement, the holes may have a square shape. However, this is not necessarily the case. For example the holes could be circles arranged in a square lattice arrangement or in a hexagonal close packed arrangement. Other lattice arrangements are possible, and in some embodiments the holes are arranged randomly.

As there may be advantages associated with the aforementioned tension in the membrane, it is desirable to optimise the structure of the transducer so as to optimise the tension in the membrane. A factor that may affect the performance of the transducer in this way is any tension of the membrane that is introduced at the manufacturing stage of the transducer. For example when the backplane, spacer and membrane are assembled, they may be bonded together (e.g. at the edges of the members, or across the surface of the members, as discussed further herein below) so as to introduce a pre-tension to the membrane.

It may be particularly desirable to maximise the magnitude of vibrations of the membrane, as this may maximise the acoustic response to the applied electrostatic potential. However, should the membrane be displaced too far, it may contact the backplane member. The presence of the spacer member prevents the membrane contacting the backplane member across the entire surface of the membrane, and the transducer will still function if the membrane touches the backplane member in a small region corresponding to the centre of the holes in the spacer member.

In some embodiments there is no contact between the membrane and the backplane member. Thus in some embodiments the membrane is provided with a pre-tension when the transducer is manufactured, such that when the electrostatic potential reaches a maximum of its dynamic range, the displacement of the portions of the membrane is less than or substantially equal to the thickness of the spacer member.

Conversely, in some embodiments the membrane does touch the backplane. The membrane may be provided with a pre-tension to allow contact between the membrane and the backplane during some or all of the time that an electrical potential is applied. For example, the membrane may touch the backplane only when the electrical potential is high. Alternatively, the membrane may remain in contact with the backplane while the electrical potential is applied, and move in response to variation in the electrical potential, so that the area in contact with the backplane varies as the membrane moves.

It will be appreciated from the above that the desired pre-tension of the membrane may depend to some extent of the thickness of the spacer member. The spacer member can have any suitable thickness, however the thickness of the spacer member may be between 15 μm and 3 mm, e.g. between 0.1 mm and 1 mm, e.g. about 0.5 mm. As discussed above, the backplane, spacer and membrane may be bonded at their edges. Additionally or alternatively, these members may be bonded together, either in part or across their entire surfaces. For example, the members may be bonded at bonding lines spaced across them. As another example, the membrane may be bonded to the spacer member at multiple discrete points between some of the holes in the spacer member. There may be bonding provided between the backplane and spacer members, between the spacer member and the membrane, or between both the backplane and spacer members and the spacer member and the membrane. The bonds between the members may have negligible thickness or may serve as further spacers separating the members.

The backplane, spacer and membrane may each comprise a substantially planar sheet.

The electrically conductive backplane member may be made of any suitable material or combination of materials. The electrically conductive backplane member may be rigid, but may be semi-rigid or flexible. For example, the backplane member may be a composite layer comprising a polymer sheet having a conductive layer applied thereon by metallization, e.g. by vapour deposition. The conductive layer may comprise aluminium. Alternatively, the backplane member may comprise a metal sheet. In some embodiments, the metal sheet is aluminium. The backplane member may have any suitable thickness, e.g. between 0.2 mm and 5 mm, e.g. about 1 mm.

The apertures in the backplane member may be circular. The apertures may have a maximum lateral dimension (parallel to the median plane of the backplane member) of between 0.5 mm and 2 mm, e.g. about 1 mm. The spacing between the apertures may be between 0.5 mm and 5 mm, e.g. about 1 mm. The term "spacing" as used herein with reference to aperture spacing has the meaning of the distance between the closest edges of adjacent apertures (i.e. the thickness of the material between the apertures), rather than, for example, the distance between the centres of adjacent apertures.

The spacer member may be made of any suitable material or combination of materials, but preferably it is made from a polymer, e.g. Mylar. The spacer member may be rigid, semi-rigid or flexible.

In some embodiments the spacer member is electrically insulating. However the Applicant also envisages that the spacer member could be conductive—e.g. by having a conductive layer overlaid on an insulating substrate to which the electrical potential is applied, such that the membrane is also attracted to the conductive layer of the spacer member. This may provide an advantage that a greater attractive force is provided (due to the greater proximity of the membrane to the conductive layer on the spacer member compared with its proximity to the backplane membrane). A smaller potential may therefore be needed to bring the membrane into contact with the spacer member. The conductive layer may extend over the walls of the apertures. This may provide an advantage that the attraction of the membrane to the conductive layer may contribute to the movement of the membrane portions spanning the holes.

The flexible electrically conductive membrane may be made of any suitable material or combination of materials. It may be made entirely from electrically conductive material or it may be made only partially of electrically conductive materials, e.g. it may comprise an electrically conductive layer overlaid onto an electrically insulating layer. Preferably it is made from a metallised polymer sheet. For example, the membrane may be made from a Mylar polymer sheet having a layer of aluminium deposited thereon by metallization. The membrane may be between 4 μm and 0.5 mm thick, e.g. 6 μm and 0.1 mm thick, e.g. about 10 μm thick.

The thickness of each member may be constant, or may vary across the transducer.

The holes may each have a maximum lateral dimension less than twice a minimum lateral dimension. The backplane member may be electrically conductive. The spacer member may be electrically insulating. Preferably the transducer is arranged in use to apply an electrical potential which gives rise only to an attractive electrostatic force between the conductive layer and the membrane.

FIG. 1 shows a transducer 100 comprising a backplane member 102, with a thickness of 1 mm. The backplane member 102 is made from an aluminium sheet, although other materials or combinations of materials could be used. Disposed over the backplane member is an insulating spacer member 104. The spacer member 104 is 0.3 mm thick, and is made from the polymer Mylar.

Disposed over the spacer member 104 is a composite membrane 106. The membrane 106 comprises a polymer sheet of 10 μm thickness, with an aluminium layer 110 deposited thereon via metallisation. In the present embodiment, the aluminium layer is provided on the surface of the polymer sheet 108 that faces away from the spacer member 104. However, in other embodiments, the membrane may comprise a conducting layer on the side of the polymer layer facing the spacer member, or a conducting layer could be sandwiched between two polymers sheets. In some embodiments, instead of the composite membrane there could be a single flexible conducting layer.

The backplane member 102 is provided with an array of through apertures 112. The apertures 112 are circular with a diameter of 3 mm, and with an inter-aperture spacing of 2 mm. The through apertures 112 are positioned in a regular square lattice arrangement.

Figure 2:
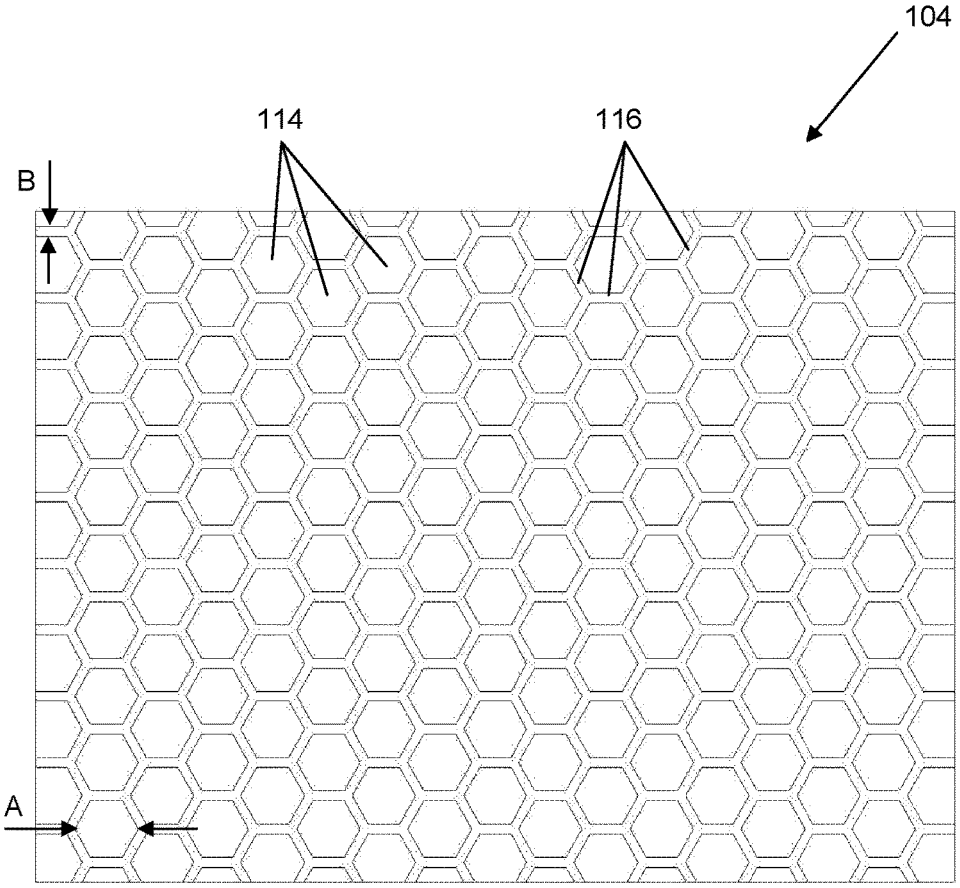
FIG. 2 is a plan view of the spacer member of the transducer of FIG. 1, showing the holes through the spacer member.

The spacer member 104 is provided with an array of through holes 114. As shown in FIG. 2, the through holes 114 have a hexagonal shape and are arranged in a hexagonal close packed arrangement, i.e. in a honeycomb arrangement. They have a maximum lateral dimension (vertex to vertex, as indicated by arrows A) of 22 mm and a minimum lateral dimension (edge to edge) of 19 mm. The spacing between the holes 114 defines an inter-hole wall 116. The inter-hole wall 116 has a thickness (as indicated by arrows B) of 3 mm.

Figure 3:
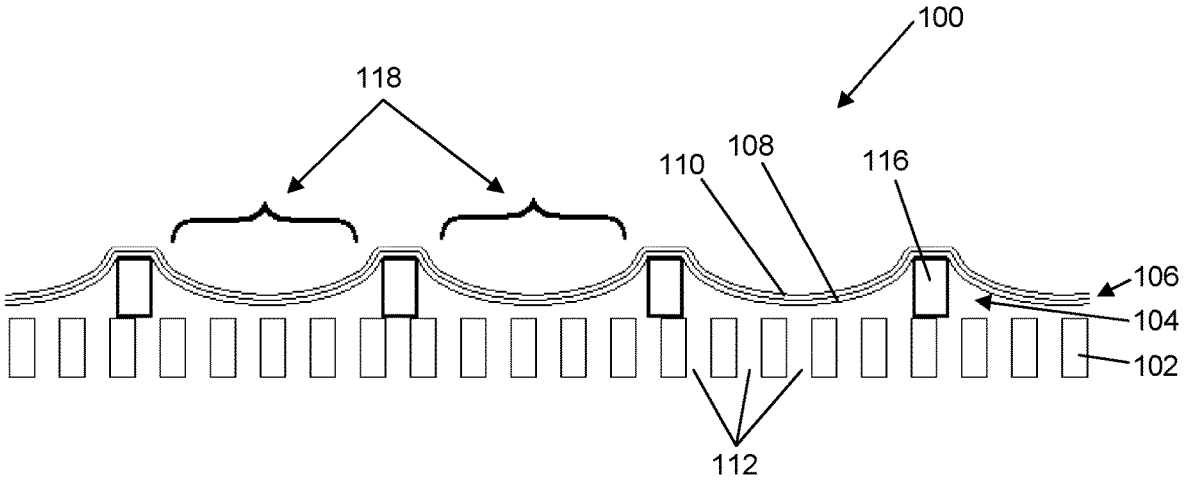
FIG. 3 is a diagrammatic section through the transducer of FIG. 1, showing the position of the membrane when a non-zero electric potential is applied to the transducer.

In use, a varying electrostatic potential is applied to the backplane member 102, and the conducting aluminium layer 110 of the membrane 106. This is shown in FIG. 3. The electrical potential consists of a DC potential (250V) added to an AC drive signal (+1-200V), the latter corresponding to the desired sound. This results in a potential that can vary between 50V and 450V, depending on the desired sound waveform. The electrical potential causes an attractive electrostatic force between the backplane member 102 and the membrane 106 that depends on the strength of the potential. The membrane 106 has portions 118 that are displaced towards the backplane member 102 as a result of the force, moving the air around them. An acoustic response to the electrical signal is thereby produced.

As the portions 118 deform in order to move closer to the backplane member 102, tension is created in the portions 118 of the membrane spanning the hole 114. This tension provides a biasing force biasing the portions 118 back towards their equilibrium positions so that when the electrical potential is decreased, the biasing force due to tension provides a return spring effect, restoring the portions 118 of the membrane 106 towards their equilibrium positions, thereby improving the acoustic performance of the transducer.

In the present embodiment, no bonding is provided between the members 102, 104, 106. However, in other embodiments the members 102, 104, 106 could be bonded together in part or across their entire surface where they are in contact. For example, the membrane 106 could be bonded in some places where it contacts the upper surface of the inter-hole walls 116. Similarly, the backplane member 102 could be bonded to the spacer member 104 in some or all places where it contacts the bottom of the inter-hole walls 116.

Figure 4:
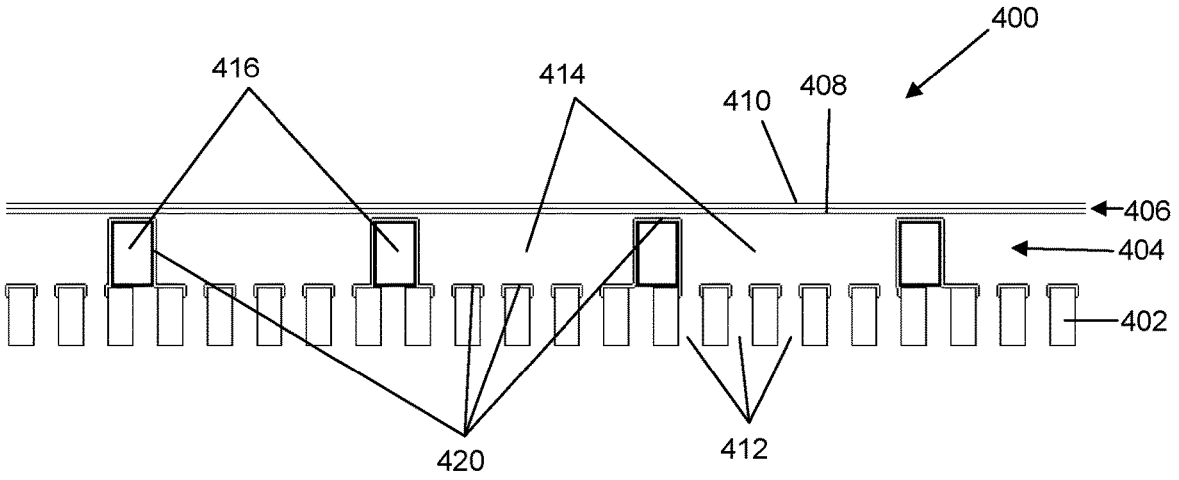
FIG. 4 is a diagrammatic section through a transducer in accordance with another embodiment of the invention, wherein a conductive layer is overlaid on the spacer member.

FIG. 4 shows a transducer 400 having corresponding features to those of the embodiment of FIG. 1, i.e. a backplane member 402; a spacer member 404 disposed over the backplane member 402; and a composite membrane 406. In addition, in this embodiment however a conductive metal layer 420 is applied over the spacer member 404. In this embodiment the metal layer 420 is in fact continued over the backplane member 402 in which case it is not necessary for the backplane member to be conducting. The substrate of the spacer member 404 is 0.3 mm thick, and is made from the polymer Mylar. The conductive layer 420 is created by metallization of the spacer member 404 and the backplane member 402, so that the conductive layer 420 covers the exposed upper surfaces of the spacer member 404 and the backplane member 402, as well as the walls of the holes in the spacer member 404. The conductive layer also extends partially down the walls of the apertures in the backplane member 402. In other embodiments separate metal layers could be applied to the spacer member and the backplane member or a metal layer could be applied to the spacer member only. The membrane 406 comprises a polymer sheet of 10 μm thickness, with an aluminium layer 110 deposited thereon via metallisation.

Figure 5:
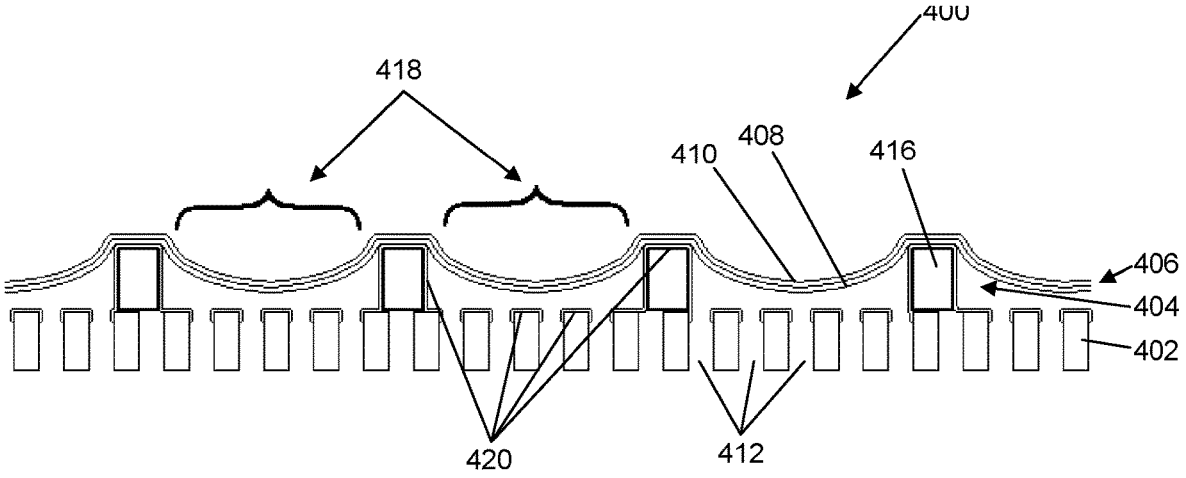
FIG. 5 is a diagrammatic section through the transducer of FIG. 4, showing the position of the membrane when a non-zero electric potential is applied to the transducer.

In use, a varying electrostatic potential is applied to the conductive layer 420, and the conducting aluminium layer 410 of the membrane 406. This is shown in FIG. 5. The electrical potential consists of a DC potential (250V) added to an AC drive signal (+/−200V), the latter corresponding to the desired sound. This results in a potential that can vary between 50V and 450V, depending on the desired sound waveform. The electrical potential causes an attractive electrostatic force between the conductive layer 420 and the membrane 406 that depends on the strength of the potential. The membrane 406 has portions 418 that are displaced towards the conductive layer 420, and thus towards the backplane member 402, as a result of the force, moving the air around them. An acoustic response to the electrical signal is thereby produced.

The portions 418 deform in order to move closer to the conductive layer 420 (and thus to the backplane member 402), creating tension in the portions 418 of the membrane spanning the hole 414. As in the previous embodiment, this tension provides a biasing force biasing the portions 418 back towards their equilibrium positions so that when the electrical potential is decreased, the biasing force due to tension provides a return spring effect, restoring the portions 418 of the membrane 406 towards their equilibrium positions, thereby improving the acoustic performance of the transducer.

It will be appreciated by those skilled in the art that only two possible embodiments have been described and that many variations and modifications are possible within the scope of the invention. For example, each of the members may have a different thickness, or may be made from alternative materials. The holes could have a different shape, size, spacing or pattern, and the apertures may have different shape, size, spacing or pattern.

The invention claimed is:

1. An electrostatic loudspeaker comprising:

an electrically conductive backplane member having an array of through apertures;

a spacer member disposed over the backplane member, the spacer member having an array of holes therethrough, the holes each having a maximum lateral dimension less than twice a minimum lateral dimension; and a flexible electrically conductive membrane disposed over the spacer member, wherein the loudspeaker is arranged in use to apply an electrical potential which gives rise to an attractive electrostatic force between the backplane member and the membrane thereby moving portions of the membrane spanning said holes in the spacer member towards said backplane member, and wherein the membrane is bonded to the surface of the spacer member where the membrane contacts the spacer membrane between the holes, and wherein the backplane, spacer and membrane are bonded together so as to introduce a pre-tension to the membrane such that the membrane is under tension when zero electrical potential is applied.

2. The electrostatic loudspeaker of claim 1, wherein the ratio between the maximum and minimum lateral dimensions is less than 1.5.

3. The electrostatic loudspeaker of claim 1, wherein the membrane is held in contact with the spacer member by at least one of a mechanical pre-tension, by bonding and/or by an electrical potential.

4. The electrostatic loudspeaker of claim 1, wherein the loudspeaker is arranged in use to apply an electrical potential which gives rise only to an attractive electrostatic force between the backplane member and the membrane.

5. The electrostatic loudspeaker of claim 1, wherein the holes have a shape that is selected from the group consisting of: circular, hexagonal, square and oval.

6. The electrostatic loudspeaker of claim 1, wherein the holes have a maximum lateral dimension between 1 mm and 50 mm, between 10 mm and 40 mm, or between 20 mm and 30 mm.

7. The electrostatic loudspeaker of claim 1, wherein the holes have a maximum lateral dimension between 2 and 50 times greater than the maximum lateral dimension of the apertures in the backplane member.

8. The electrostatic loudspeaker of claim 1, wherein the spacing between the holes in the spacer member is between 1 and 5 mm.

9. The electrostatic loudspeaker of claim 1, wherein every hole in the spacer member has the same size and shape.

10. The electrostatic loudspeaker of claim 1, wherein some holes in the array of holes have at least one of:

a different size from other holes in the array of holes; or a different shape from other holes in the array of holes.

11. The electrostatic loudspeaker of claim 1, wherein at least one of the size, spacing, shape and/or pattern of the holes varies across the surface of the spacer member.

12. The electrostatic loudspeaker of claim 1, wherein the holes are arranged in a hexagonal close packed array.

13. The electrostatic loudspeaker of claim 1, wherein the holes are arranged in a square lattice arrangement.

14. The electrostatic loudspeaker of claim 1, wherein the holes have substantially tessellating shapes.

15. The electrostatic loudspeaker of claim 1, wherein the membrane is provided with a pre-tension such that when the electrostatic potential reaches a maximum of its dynamic range, the displacement of the portions of the membrane is less than or substantially equal to the thickness of the spacer member.

16. The electrostatic loudspeaker of claim 1, wherein the membrane is provided with a pre-tension to allow contact between the membrane and the backplane during some or all of the time that an electrical potential is applied.

17. The electrostatic loudspeaker of claim 1, wherein the thickness of the spacer member is between 15 μm and 3 mm.

18. The electrostatic loudspeaker of claim 1, wherein the backplane, spacer member and membrane each comprise a substantially planar sheet.

19. The electrostatic loudspeaker of claim 1, wherein the backplane member is a composite layer comprising a polymer sheet having a conductive layer applied thereon by metallization.

20. The electrostatic loudspeaker of claim 1, wherein the backplane member has a thickness between 0.2 mm and 5 mm.

21. The electrostatic loudspeaker of claim 1, wherein the apertures have a maximum lateral dimension between 0.5 mm and 2 mm.

22. The electrostatic loudspeaker of claim 1, wherein the spacing between the apertures is between 0.5 mm and 5 mm.

23. The electrostatic loudspeaker of claim 1, wherein the spacer member is made from a polymer.

24. The electrostatic loudspeaker of claim 1, wherein the spacer member comprises a conductive layer overlaid on an insulating substrate.

25. The electrostatic loudspeaker of claim 1, wherein the flexible electrically conductive membrane comprises an electrically conductive layer overlaid onto an electrically insulating layer.

26. The electrostatic loudspeaker of claim 1, wherein the membrane is between 4 μm and 0.5 mm thick.

27. The electrostatic loudspeaker of claim 1, wherein the thickness of at least one of the spacer member and the electrically conductive backplane member varies across the loudspeaker.

28. A method of manufacturing an electrostatic loudspeaker, the method comprising:

providing an electrically conductive backplane member having an array of through apertures;

disposing a spacer member over the backplane member, the spacer member having an array of holes therethrough, the holes each having a maximum lateral dimension less than twice a minimum lateral dimension;

disposing a flexible electrically conductive membrane over the spacer member;

placing the membrane under tension and bonding the backplane, spacer member and membrane together while the membrane is under tension so as to introduce a pre-tension to the membrane, wherein bonding the backplane, spacer member and membrane together includes bonding the membrane to the surface of the spacer member where the membrane contacts the spacer member between the holes; and configuring the loudspeaker such that when an electrical potential is applied to the loudspeaker in use, the electrical potential gives rise to an attractive electrostatic force between the backplane member and the membrane, thereby moving portions of the membrane spanning said holes in the spacer member towards said backplane member.

* * * * *